US009920510B2

(12) United States Patent
Hall et al.

(10) Patent No.: US 9,920,510 B2
(45) Date of Patent: Mar. 20, 2018

(54) SMART FLUSH TOILET SYSTEM

(71) Applicants: David R. Hall, Provo, UT (US); Dan Allen, Provo, UT (US); Joshua Larsen, Provo, UT (US); Jared Reynolds, Provo, UT (US); Joe Fox, Provo, UT (US); Joseph Duncan, Provo, UT (US)

(72) Inventors: David R. Hall, Provo, UT (US); Dan Allen, Provo, UT (US); Joshua Larsen, Provo, UT (US); Jared Reynolds, Provo, UT (US); Joe Fox, Provo, UT (US); Joseph Duncan, Provo, UT (US)

( * ) Notice: Subject to any disclaimer, the term of this patent is extended or adjusted under 35 U.S.C. 154(b) by 13 days.

(21) Appl. No.: 15/176,660

(22) Filed: Jun. 8, 2016

(65) Prior Publication Data

US 2017/0254060 A1 Sep. 7, 2017

Related U.S. Application Data

(60) Provisional application No. 62/303,207, filed on Mar. 3, 2016.

(51) Int. Cl.

| | |
|---|---|
| ***E03D 11/02*** | (2006.01) |
| ***A47K 10/38*** | (2006.01) |
| ***E03D 5/10*** | (2006.01) |
| ***E03D 3/12*** | (2006.01) |
| *A47K 10/32* | (2006.01) |

(52) U.S. Cl.

CPC ..... *E03D 11/02* (2013.01); *A47K 10/38* (2013.01); *E03D 3/12* (2013.01); *E03D 5/10* (2013.01); *A47K 2010/3226* (2013.01); *A47K 2010/389* (2013.01)

(58) Field of Classification Search

CPC . E03D 3/12; E03D 10/105; A47K 2010/3226; A47K 2010/389

USPC ..... 4/305, 304, 302, 325, 405

See application file for complete search history.

(56) References Cited

U.S. PATENT DOCUMENTS

| | | | | |
|---|---|---|---|---|
| 4,882,568 A * | 11/1989 | Kyser | A47K 10/32 | 200/61.16 |
| 6,360,181 B1 * | 3/2002 | Gemmell | A47K 5/1202 | 340/675 |
| 9,255,392 B2 * | 2/2016 | Miyake | E03D 11/08 | |
| 2002/0135486 A1 * | 9/2002 | Brohagen | G08B 21/245 | 340/573.1 |
| 2005/0022292 A1 * | 2/2005 | Choi | E03D 9/08 | 4/300 |
| 2016/0083949 A1 * | 3/2016 | Plas | E03D 5/105 | 4/420 |

FOREIGN PATENT DOCUMENTS

JP 2000008445 A * 1/2000

* cited by examiner

*Primary Examiner* — Erin Deery

(57) ABSTRACT

A smart flush toilet apparatus provides dynamic control of a toilet flush length and/or a toilet flush water volume based on data collected from toilet paper dispenser sensors and/or toilet bowl displacement sensors. A toilet paper dispenser may be used to report toilet paper usage to resupply toilet paper.

1 Claim, 11 Drawing Sheets

SMART FLUSH TOILET SYSTEM

RELATED APPLICATION

This patent application claims priority to U.S. Provisional Application No. 62/303,207, filed Mar. 3, 2016, entitled Smart Toilet Dispenser.

BACKGROUND

Field of the Invention

This invention relates to methods and systems for dispensing toilet paper and dynamically flushing a toilet based on an amount of toilet paper dispensed.

Background of the Invention

Toilet users have variation in the way they use the toilet and the amount of waste that enters a toilet bowl and needs to be removed. Surprisingly, there is a consistency in a typical toilet flush mechanism which doesn't match the variations in toilet use. This conflict between the broad range of user needs and fixed rate of toilet flush may cause problems as varied as wasting water by over flushing, creating clogs by under flushing or producing an overflow from a backed up system. These problems cause inconvenience to the user and damage to the toilet and surrounding areas. The reasons toilet users have these problems are diverse but may include using toilets that have a fixed rate of water flow and variations in toilet paper use that a fixed rate toilet cannot adjust to. The innovations disclosed herein address these problems using a smart flush toilet system.

SUMMARY

This invention has been developed in response to the present state of the art and, in particular, in response to the problems and needs in the art that have not yet been fully solved by currently available systems and methods. Accordingly, improved systems and methods have been developed to dynamically flush toilets. Features and advantages of different embodiments of the invention will become more fully apparent from the following description and appended claims, or may be learned by practice of the invention as set forth hereinafter.

Consistent with the foregoing, a smart flush toilet system is disclosed. In one embodiment a toilet controller may controls a flush length or a flush water volume of a toilet flush event based on an amount of toilet paper dispensed by a toilet paper dispenser. The toilet paper dispenser may report an amount of toilet paper dispensed to the toilet controller within a toilet or to a remote computer or remote server. The toilet controller may be able to control a flush length or a flush water volume based on the amount of toilet paper dispensed. In another embodiment, one or more water level displacement sensors may detect a water level displacement within a bowl of the toilet and report the displacement to a toilet controller. The toilet controller may control the flush length or the flush water volume based on the amount of toilet paper dispensed and/or a change in the water level displacement with the bowl. Toilet bowl displacement sensors may be placed in or around a bowl of a toilet and may communicate wirelessly to a toilet controller water displacement changes within the toilet bowl. The changes may be associated with an amount of toilet paper dispensed and the combined information may be used by a toilet controller to control a flush volume or flush length of a toilet.

A toilet paper roll dispenser which may track and report to a flush controller of a smart toilet an amount of toilet paper used. An amount of toilet paper used and additional information from displacement sensors placed along the toilet bowl allow a toilet flush controller to adjust a flush volume or a length in order to efficiently and effectively flush a toilet. Toilet users require varying amounts of toilet paper. The toilet paper dispensed is measured by one or more sensors associated with a toilet paper dispenser. A toilet paper dispenser may communicate with a toilet flush controller in the toilet to provide information about an amount of toilet paper dispensed in connection with a toilet flush event. Toilet paper dispenser sensors may be optical, capacitive, inductive, resistive, and/or ultrasonic and may provide information about the thickness, weight and length of the toilet paper used. The toilet paper dispenser apparatus may also monitor the toilet paper that remains on the roll. When the toilet paper roll reaches a level of depletion or a predetermined threshold level one or more sensors may send a wireless notification to the users preferred notification method (a user's account viewable in a web browser or smart phone or tablet or toilet control tablet). This notification alerts a user or a janitorial or household staff member that the toilet paper is depleted and needs to be replaced. There may also be a notification signal (such as a blinking light) located on the exterior housing of the apparatus to alert the user of low toilet paper availability. The users account could be programmed to track the amount of toilet paper used in allotted timeframe. When the overall toilet paper supply reaches a predetermined level the system could automatically add toilet paper to the online shopping cart for the next order, thus insuring the user avoids a shortage. There may also be a manual alert system to be employed in the event of the user being stranded on the toilet with an exhausted toilet paper supply. When the alert button is pressed a wireless communication may be sent in real time via text, email, instant message or other preferred method to the designated attendant to replenish the toilet paper supply immediately. As fluctuating amounts of waste enter the toilet, various sensors in and around the water area of the toilet bowl may measure the amount of solids in the water, water displaced and gauge toilet bowl water levels. These bowl sensors may also communicate with each other and collect data through resistance, conductive, capacitance methods that may transfer signals through the water. The smart flush system sensors could communicate wirelessly from their position on the toilet bowl and toilet paper distribution apparatus to the controller within the toilet. This controller may be designed to analyze the data to regulate the water volume and force of the flush and the flush length to optimize the flush according to the amount of waste to remove from the toilet.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, may be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings.

Figure 1:
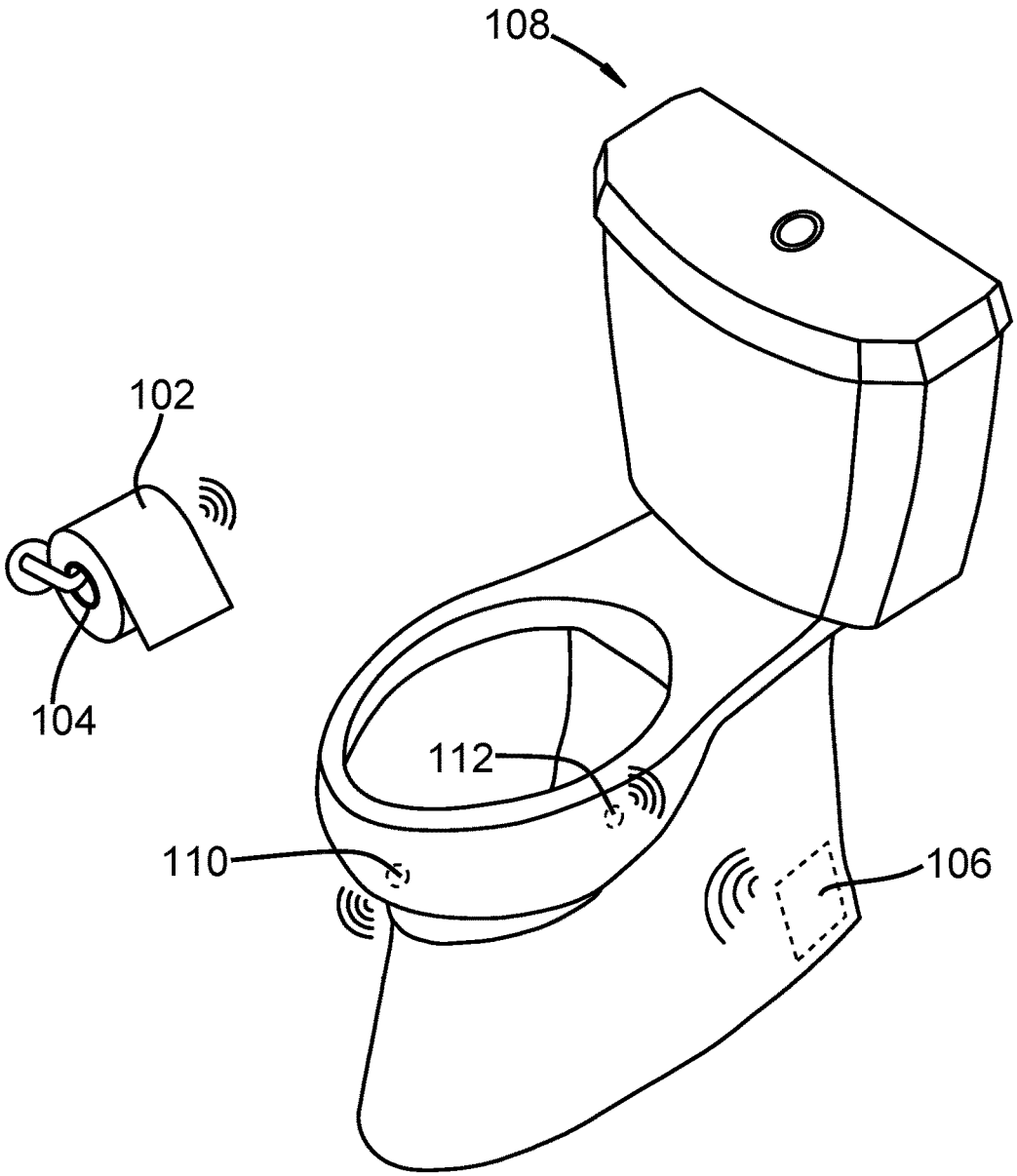
FIG. 1 is a perspective view of a toilet apparatus in accordance with an embodiment of the invention.

FIG. 1 illustrates a smart flush toilet system utilizing a toilet controller 106, a wireless toilet paper dispenser 104, and toilet bowl displacement sensors 110 and 112. Controller 106 may communicate wirelessly with a toilet paper roll dispenser 104. Toilet paper dispenser 104 may dispense toilet paper 102 to users of toilet 108. The amount of toilet paper dispensed may be measured or tracked and reported to toilet controller 106. The amount of dispensed toilet paper 102 may influence a flush water volume or a flush length of a toilet flush event of toilet 108. Controller 106 may receive a signal from the toilet paper dispenser 104 which may provide a first flush input to controller 106. Toilet paper dispenser 104 may measure weight, thickness, length, surface area, movement, etc., of toilet paper 102 as it is being dispensed from dispenser 104. Toilet paper use data produced by dispenser 104 may be transmitted to controller 106 and/or another computer system located remote from toilet 108 such as a remote Internet database server. The toilet paper use data may be used to reorder toilet paper or predict a future reorder date or future need for toilet paper at a specific location associated with dispenser 104 and communicate such information to a restocking service in real time via email, instant message, text or other method of communication. Dispenser 104 may contain a controller (shown in FIG. 7) with internal memory, processing capabilities, and bidirectional communication capabilities. Toilet controller 106 may also receive toilet bowl displacement data from displacement sensors 110 and 112. The displacement sensors may be placed to measure water displacement and may be located adjacent to a toilet bowl surface. Sensors 110 and 112 may also be directly contacting or indirectly contacting toilet bowl liquid adjacent an inner surface of the toilet bowl. Sensors 110 and 112 may detect a change in liquid displacement within a bowl of a toilet. The change in liquid displacement may be correlated to a toilet use event and/or to a toilet paper use amount in order to control a toilet flush mechanism. Controller 106 may flush toilet 108 by means of a solenoid valve, a motor, a linear actuator, or an electromechanical actuator. Toilet controller may provide an electrical signal to a flush actuator enabling control of a flush length or a flush water volume based on a toilet paper use amount and/or a water displacement amount.

Figure 2:
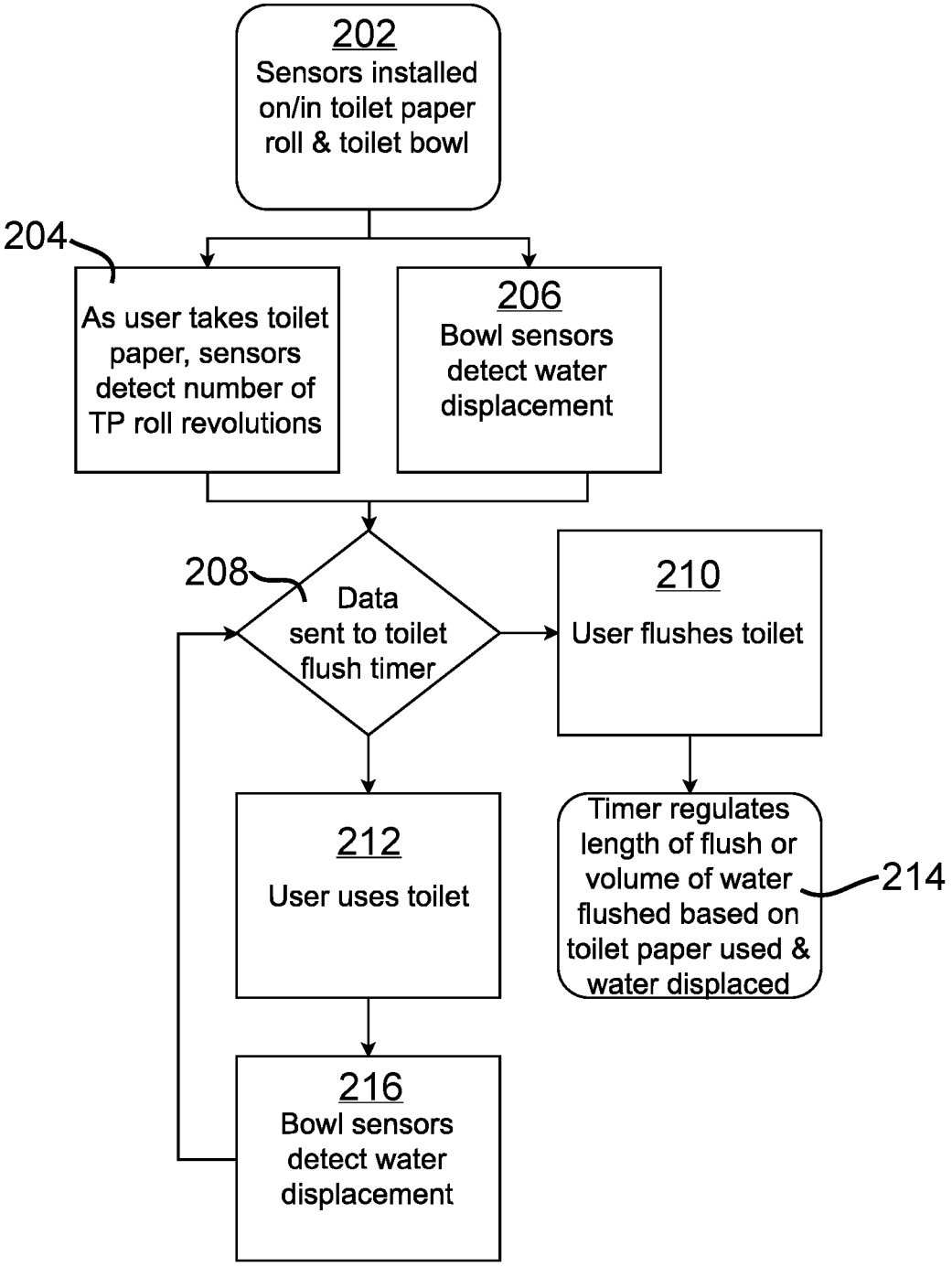
FIG. 2 is a flow diagram of a toilet apparatus in accordance with an embodiment of the invention.

FIG. 2 shows a flow diagram of one embodiment of a smart flush toilet. A toilet paper dispenser senses an amount of toilet paper dispensed as a toilet user takes toilet paper from the dispenser. Information about the amount of toilet paper dispensed may be collected by the sensors and sent to the controller. Sensors such as encoders, optical transmitter/receiver pairs, capacitive detectors, weight transducers, strain gages, acoustic transceivers, and cameras may be used in to detect an amount of toilet paper dispensed. As the user takes toilet paper 204, the sensors may sense a number of revolutions of the toilet paper roll, the weight and thickness of the toilet paper, the amount of toilet paper removed, and/or an optical movement of the toilet paper dispensed in order to detect the amount of toilet paper dispensed. The bowl sensors may detect water displacement 206 and send this data to the toilet flush timer 208. The flush timer may be located in a toilet controller such as is shown in FIG. 1 at 106. A user may flush the toilet which may signal the controller to adjust the water volume and length of the flush based on the toilet paper used and the water that is displaced. Another use at this time, is that 212 the user may use the toilet. The bowl sensors may then detect the water displacement 216 and may send that data back to the toilet flush timer controller 208. When the user flushes the toilet 210, the data may be processed by the controller and the timer regulates the length of flush or the volume of the water flushed based on the toilet paper usage and the water displaced 214.

Figure 3:
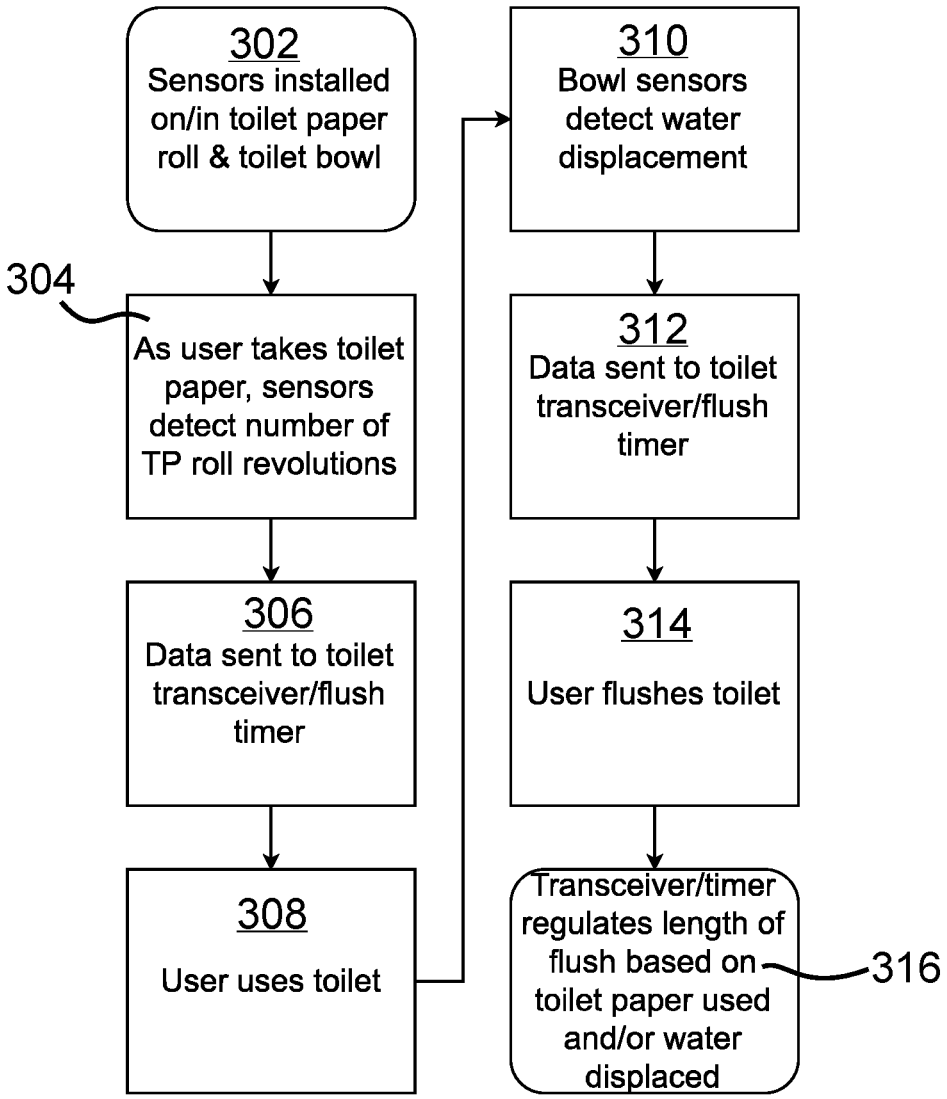
FIG. 3 is a flow diagram of a toilet apparatus in accordance with an embodiment of the invention.

In FIG. 3, sensors in a toilet paper roll dispenser may be used to detect an amount of toilet paper dispensed and the toilet bowl. As the user takes toilet paper, sensors may detect the number of revolutions of the toilet paper roll 304. Those sensors may also detect other information about the toilet paper including the thickness, length, weight, remaining toilet paper and any other data that may be considered relevant to the use. That data may then be sent to the toilet transceiver/flush timer 306. Toilet bowl displacement sensors 310 may detect displacement of water within a toil bowl. Toilet bowl displacement data may be sent to a toilet flush controller. The toilet flush controller may include memory, a processor, a wireless transceiver, and a flush timer 312. The toiler may flush automatically as a user steps away from the toilet or when a user manually flushes. When the toilet flushes, a timer may regulate a length of the flush based on the toilet paper usage and/or the water displaced 316.

Figure 4:
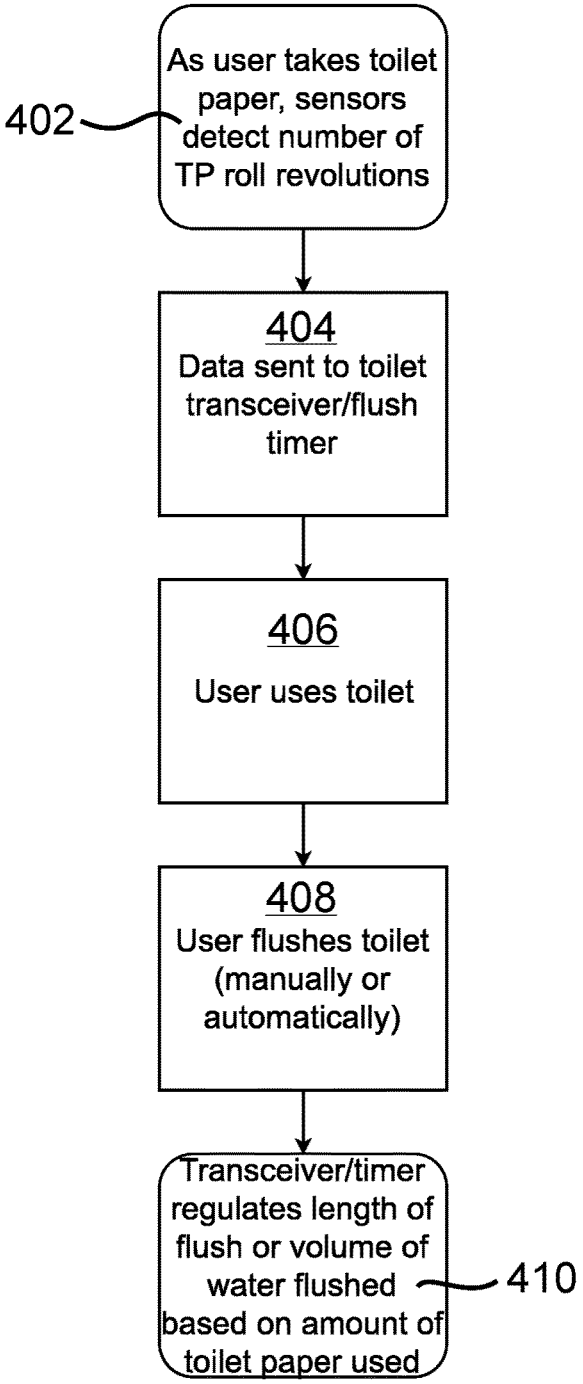
FIG. 4 is a flow diagram of a toilet apparatus in accordance with an embodiment of the invention.

FIG. 4 shows that as the user takes toilet paper 402, sensors detect information about the toilet paper including revolutions of the paper roll, which may detect the mass of the toilet paper that is used in the toilet. That data is sent to the toilet transceiver/flush timer 404. The user uses the toilet and water levels change in the bowl 406. User flushes the toilet either manually or the toilet may automatically flush depending on the sensors gauging information 408. It may be an optical sensor that triggers the flush as the user moves away from the smart toilet. It may be activated by a weight sensor that collects data from the way the users weight is distributed depending on how and where they are standing or sitting on the sensor apparatus. The toilet bowl sensors may also generate a courtesy flush depending on the data detected by the toilet bowl sensors. This may happen if the water levels rise past a specified point or if a large volume of toilet paper enters the toilet bowl. This precautionary flush may be used to prevent any possible overflow or clog. The smart toilet system may give the users a warning signal to alert them of the upcoming action. When the toilet begins its flush cycle 410, the transceiver/timer regulates the length of time of the flush and may adjust the volume of water used for the flush based upon the sensors in the toilet bowl and data input from the toilet paper dispenser roll indicating how much toilet paper was used.

Figure 5A:
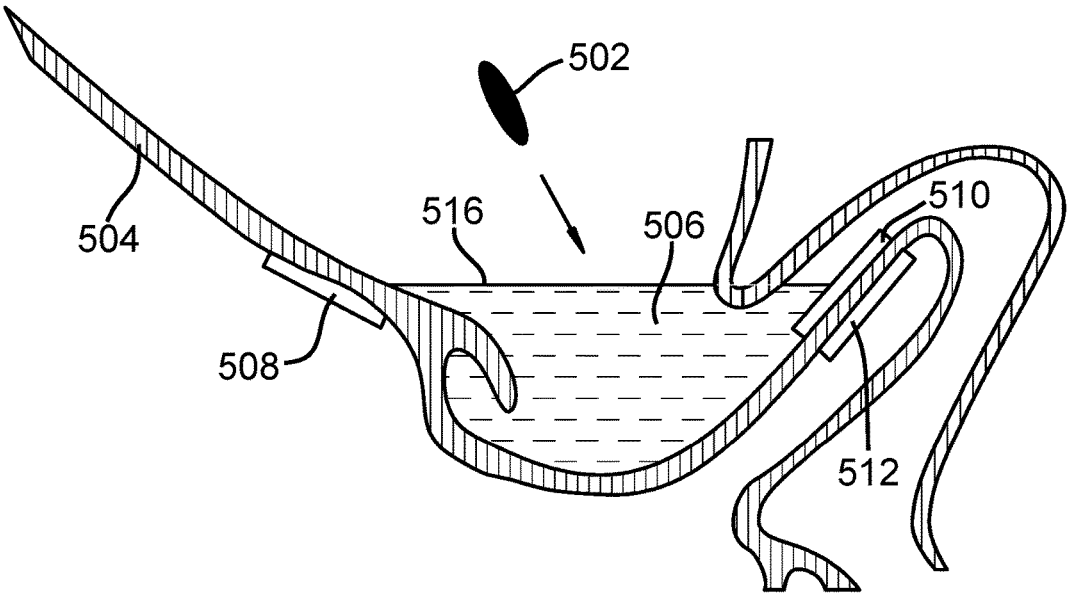
FIG. 5*a* is a cross-sectional view of a toilet apparatus showing water displacement sensors in accordance with an embodiment of the invention.
Figure 5B:
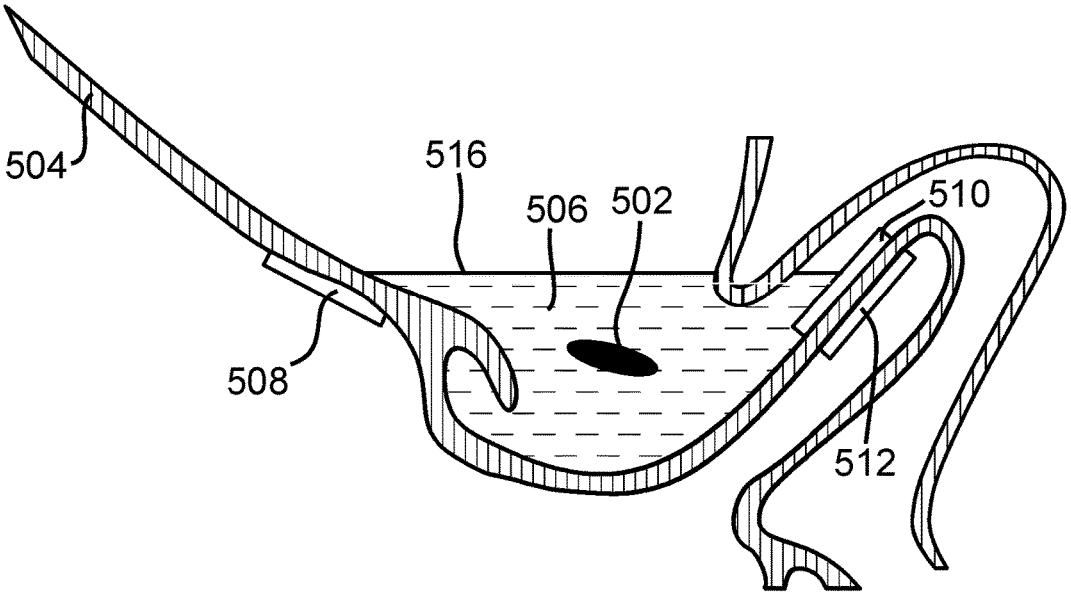
FIG. 5*b* is a cross-sectional view of a toilet apparatus showing water displacement sensors in accordance with an embodiment of the invention.

FIGS. 5*a* and 5*b* show a cross-section of the toilet bowl with the possible location of one or more water level sensors 508, 510 and 512 and a representative model of a situation where the water levels rise from the level in FIG. 5*a* to the level in FIG. 5*b*. As waste 502 is added to the water 506 in the toilet bowl 504, displacement occurs and the water level 516 rises. The sensors 508, 510 and 512 may be capacitive sensors, inductive sensors, optical sensors, ultrasonic sensors, temperature sensors or any combination thereof. The displacement sensors may also measure and transmit more data than water level information such as water conductivity and temperature. The displacement sensors may detect water levels using capacitance, resistance, reactance, inductance, temperature, optical reflection, optical transmission, or using acoustic waves. Sensors 508, 510 and 512 may wirelessly communicate with each other and with a toilet controller. There may be specific advantages to the placement of the sensors 508, 510 and 512. A first sensor 508 may be placed on or adjacent to an external surface of the toilet bowl. An external bowl surface location may be advantageous in that the sensor is isolated from water and waste within the toilet bowl. A second sensor 510 may be placed in an inner surface of a trap of the toilet where it may have the advantage of being unseen from any user. Sensor 510 may also be able to measure and collect data from the solids and liquids passing through the trap in to the sewage system. Sensor 510 may be in close proximity to a third sensor 512 which may enable a combination of sensors 510 and 512 to collect and transmit data more effectively. Displacement sensors 510 and 512 may be located adjacent a trap surface of a trap in the toilet as shown in FIGS. 5*a* and 5*b*.

Figure 6:
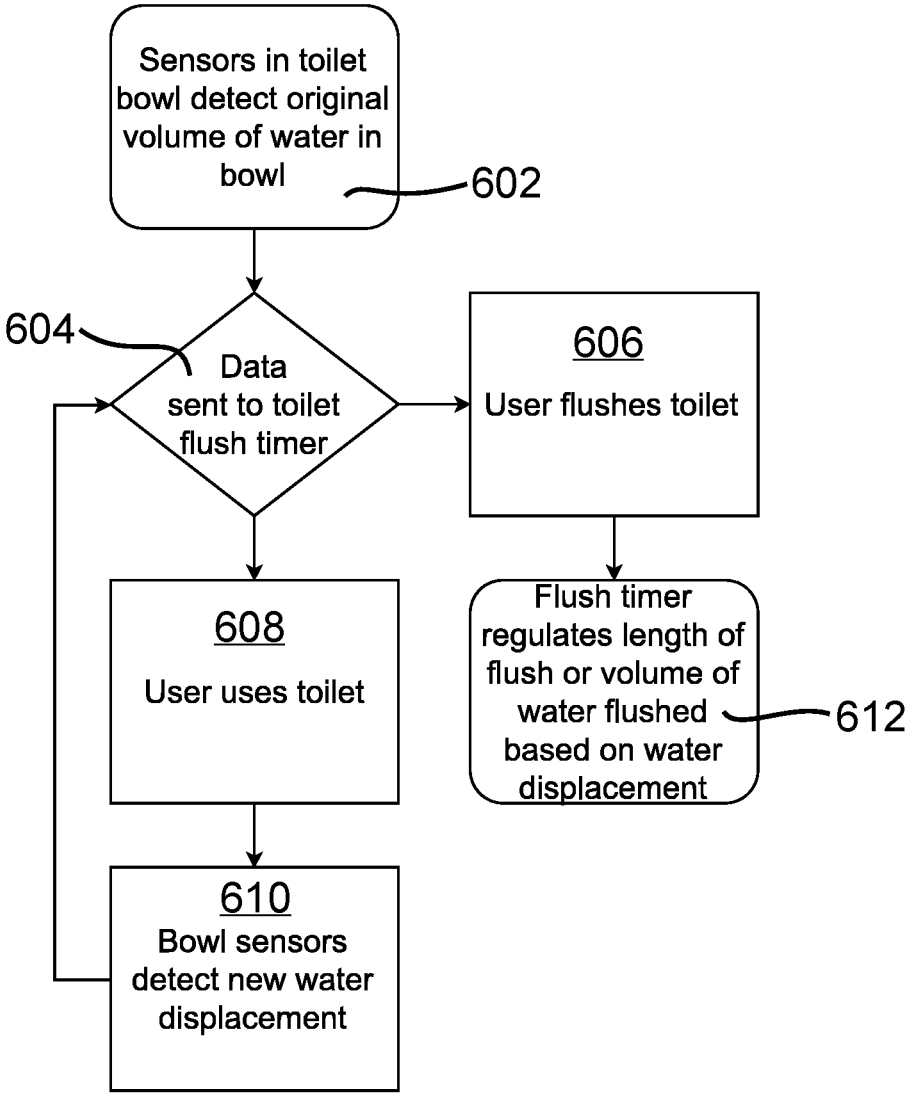
FIG. 6 is a flow diagram of a toilet apparatus in accordance with an embodiment of the invention.

FIG. 6 shows a flow diagram of the communication between the sensors, the user and the flush apparatus. 602 the sensors in the toilet bowl detect the original volume of water in the bowl and may also signal the controller if there is a discrepancy between the programmed levels and actual levels. Water may be added by the controller if the sensors detect any loss in the water levels if the toilet is unused for a prolonged period of time. During normal toilet use data may be sent to a toilet controller and flush timer. A flush timer located within a toilet controller may be set or start upon a flush start event. The flush timer may regulate a length of a flush and a volume of water used for the flush in any number of programmed combinations after receiving data from the toilet bowl sensors. This data may include information on the water displacement levels, the solids measured, or other analysis the bowl sensors gather. As the user uses the toilet, bowl sensors may simultaneously detect new water displacement and transmit that data to a controller that regulates the flush timer.

Figure 7:
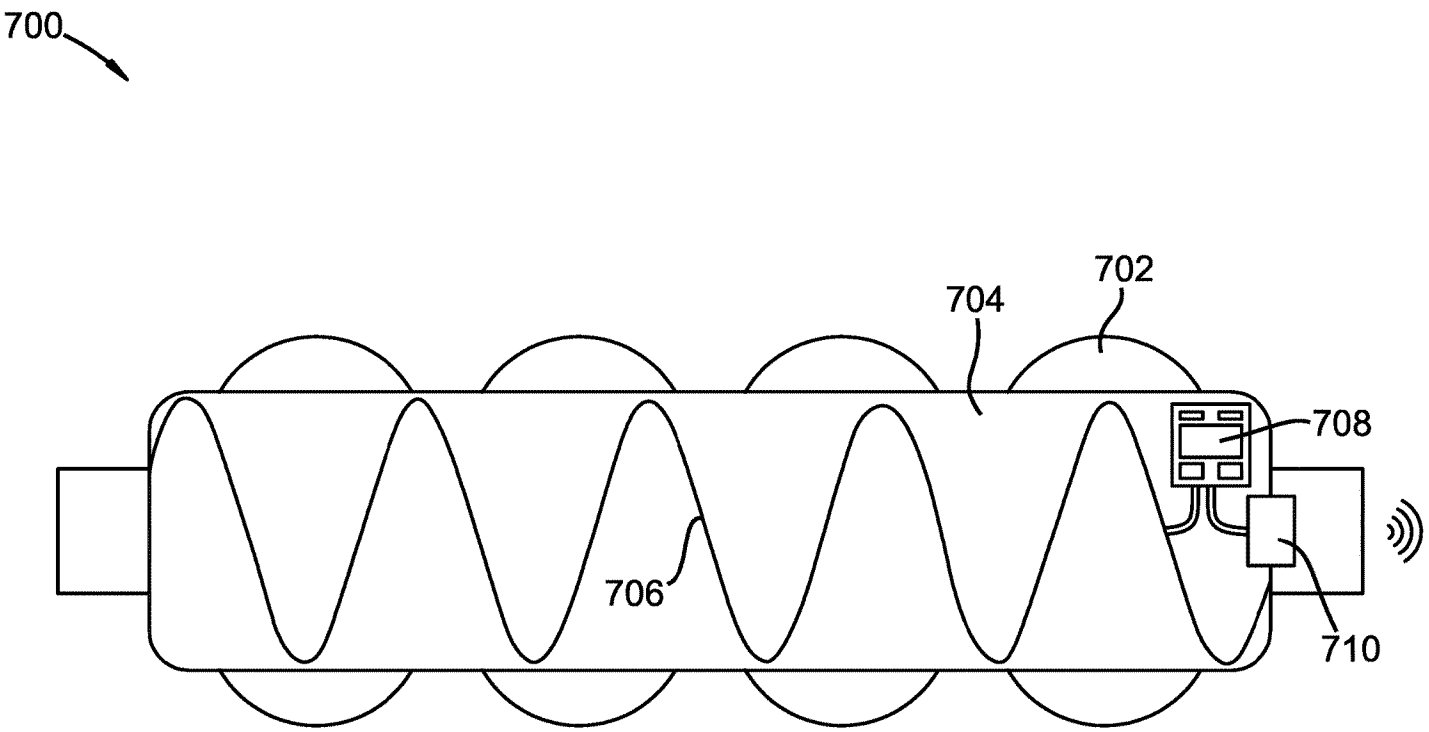
FIG. 7 is a diagram of a toilet paper dispenser in accordance with an embodiment of the invention.

FIG. 7 shows an embodiment of a toilet paper roll holder 700. Protrusions 702 grip the toilet paper roll which may enable the other components of the toilet paper roll holder to count the revolutions of the toilet paper roll and gather other applicable information. The housing or body of the toilet paper roll holder 704 may be made of plastic, metal or other appropriate material. Located within the housing may be the antenna and spring bolt 706 that may assist in communicating with the smart toilet. Controller 708 may include a processor, memory, a wireless communication module, and a power source. The power source may include a battery and/or a generator and capacitor. The battery that may be charged by a generator that may be powered by the rotations of the roll of toilet paper. The controller 708 may also be able to communicate with remote database, by way of a wireless communication module built therein, when it is time to resupply the toilet paper. Dispensed toilet paper data collected may be used to plan a frequency of the resupply of toilet paper. The encoder 710 may be an optical encoder, a resistive encoder or a magnetic encoder to detect the revolutions of the toilet paper roll. Additional sensors such as optical sensors, cameras and strain gages may also have the ability to detect other information about the toilet paper such as the sheet thickness, the weight of the paper, and how much is left on the roll. The encoder may also be used as a generator that may charge the battery or capacitor in the controller 708 as tissue is dispensed. The toilet paper roll apparatus may have the ability to communicate with and transfer data to the controller in the toilet apparatus.

Figure 8A:
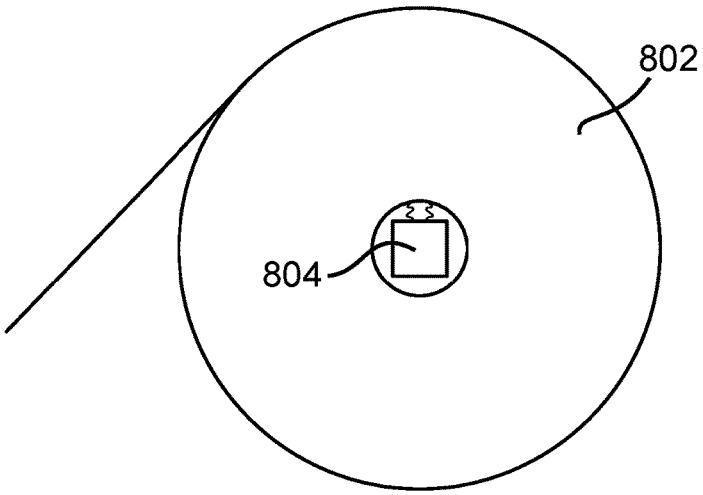
FIG. 8*a* is a diagram of a toilet paper dispenser in accordance with an embodiment of the invention
Figure 8B:
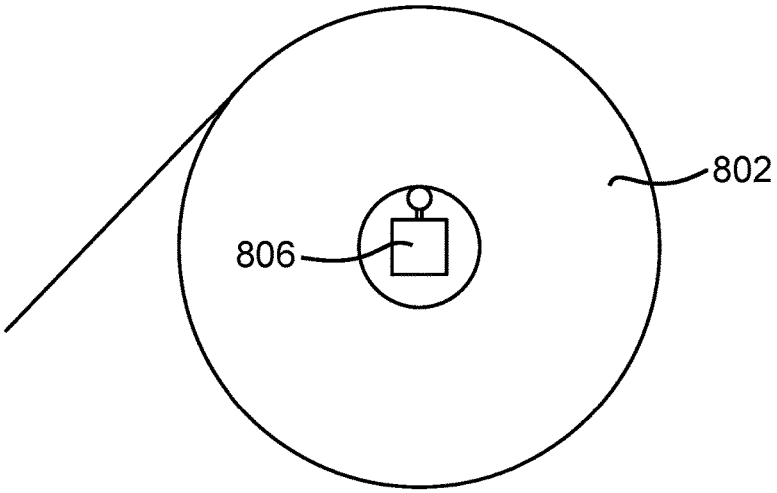
FIG. 8*b* is a diagram of a toilet paper dispenser in accordance with an embodiment of the invention.

FIGS. 8*a* and 8*b* are cross-sections of possible toilet paper roll controller and encoder apparatus that may be used to count the rotations of the toilet paper roll 802 from inside of a toilet paper roll dispenser. The controllers 804 and 806 may transmit toilet paper dispense information to a toilet flush controller. In FIGS. 8*a* and 8*b*, a mechanical weight based system is shown. The mechanical system may detect a weight and rotation of a toilet paper roll to determine an amount of toilet paper dispensed. The weight and rotation data may also be used to determine a weight and thickness of toilet paper dispensed.

Figure 9A:
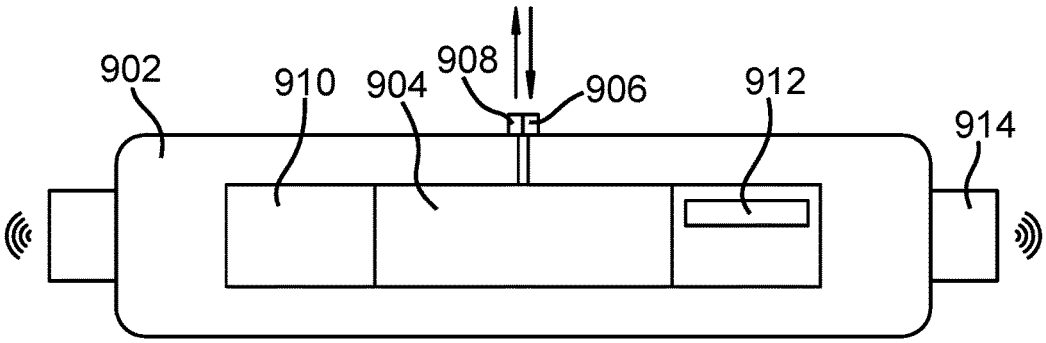
FIG. 9*a* is a diagram of a toilet paper dispenser in accordance with an embodiment of the invention.
Figure 9B:
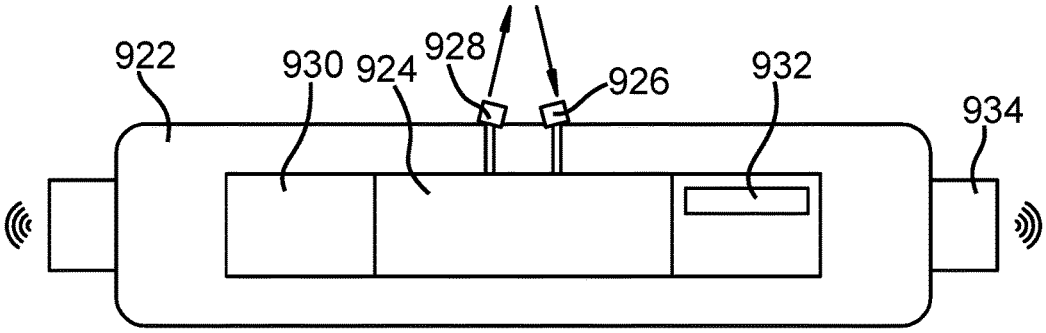
FIG. 9*b* is a diagram of a toilet paper dispenser in accordance with an embodiment of the invention.

FIGS. 9*a* and 9*b* are internal views of an embodiment of optical toilet paper roll dispensers. FIG. 9*a* shows a body 902 of the toilet paper roll dispenser, a controller 904, a power source 912, and a wireless communication section 910. The controller 904 may include memory and programming enabling optical sensors 908, 906, 928 and 926 to track movement of an inner surface of a toilet paper roll surface. Toilet paper roll holder ends 934 and 914 may include one or more strain gages for determining a weight of toilet paper on the roll holder. The toilet paper roll holder body 902 may also include one or more strain gages for determining a weight of toilet paper on the roll holder. The sensor units 906 and 908 may be optical or ultrasonic and used to detect surface movement as toilet paper is removed from the toilet paper roll. Sensor unit 906 may be used to transmit and receive sensor electromagnetic waves encoded with information about movement of a toilet paper roll or to count the revolutions of the roll. Wireless communication section 910 may be used to communicate with a toilet flush controller within a toilet. The communication section 910 may contain an antenna capable of transmitting and receiving electronic data communications to a flush controller within a toilet. FIG. 9*b* shows the body of the toilet paper roll dispenser 922 and three chambers within that body. The center chamber 924 may be used to house the controller system. The sensor units 926 and 928 are situated at 45 degree angles to optimize reception of a reflected electromagnetic wave. Sensors 908, 906, 928 and 926 may work like an optical mouse, detecting movement of an inner surface of a toilet paper roll.

Figure 10:
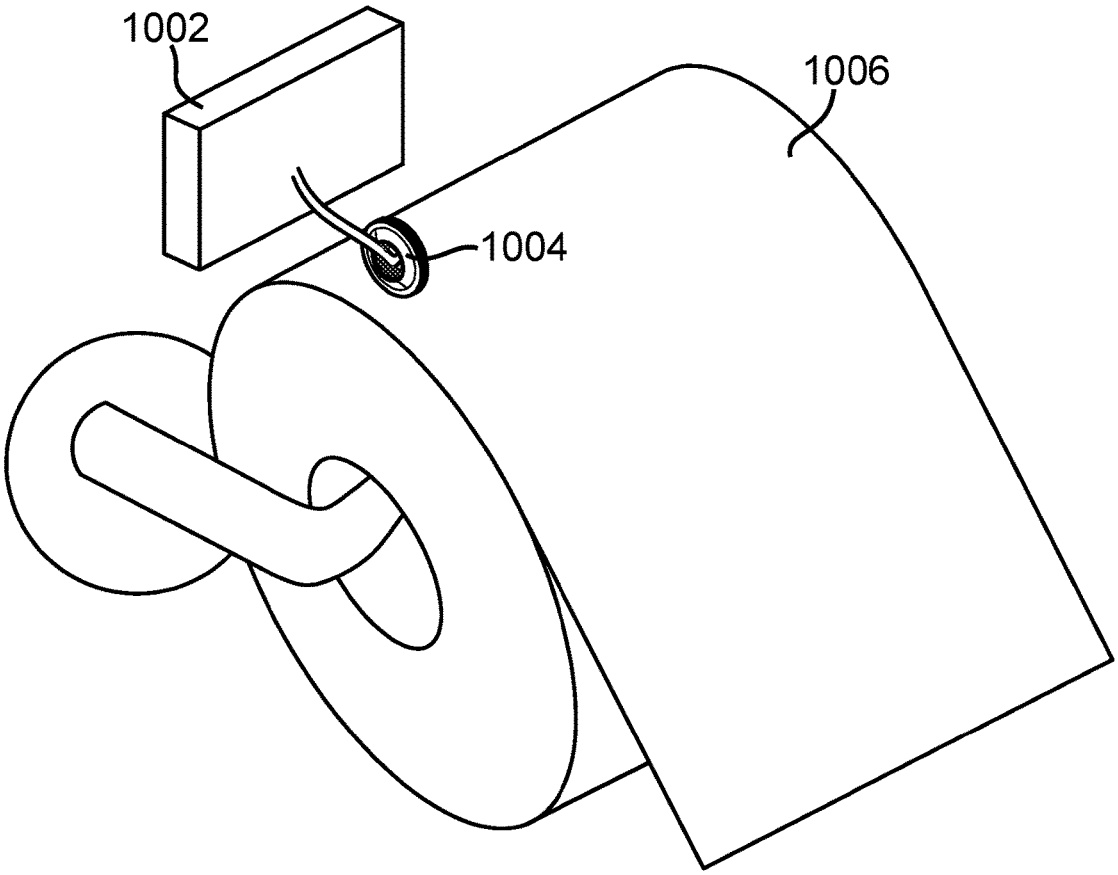
FIG. 10 is a diagram of a toilet paper dispenser in accordance with an embodiment of the invention.

FIG. 10 shows a toilet paper roll housing and tracking system located outside of the body of the toilet paper dispenser roll holder. Controller 1002 may include a memory section, a battery section, and a wireless communication section. The battery may power the controller 1002 by the revolutions of the wheel 1004, and a wireless communication section to send data to the toilets flush controller. The wheel 1004 may rotate as the toilet paper 1006 is dispensed creating energy that may charge the battery. The current produced by rotation may be used to determine an amount of toilet paper dispensed. Wheel 1004 may also be an encoder which may track an absolute position of the wheel and thus determine a linear amount of toilet paper dispensed. Controller 1002 may also be programmed to note the amount of toilet paper remaining and send a signal to a remote computer that is connected to the Internet and automatically order toilet paper refills. A housing (not shown) may be made of a hard plastic or metal alloy and substantially enclose and protect the controller equipment and toilet paper. It may have an opening along the bottom for the toilet paper to exit and have an apparatus to allow it to open to replace the toilet paper and correctly align the wheel apparatus. An alert button (not shown) may be placed on a side of the housing or along a toilet paper roll or toilet paper roll support and, when pressed, causes controller 1002 to send a signal to a remote computer, remote database, or to a toilet controller within a toilet, in real time, to request a toilet paper refill. Pressing the button may alert a janitorial or household staff via text, email, instant message or other preferred method that the user is without toilet paper. The staff member could then deliver the toilet paper for the user's needs.

Figure 11A:
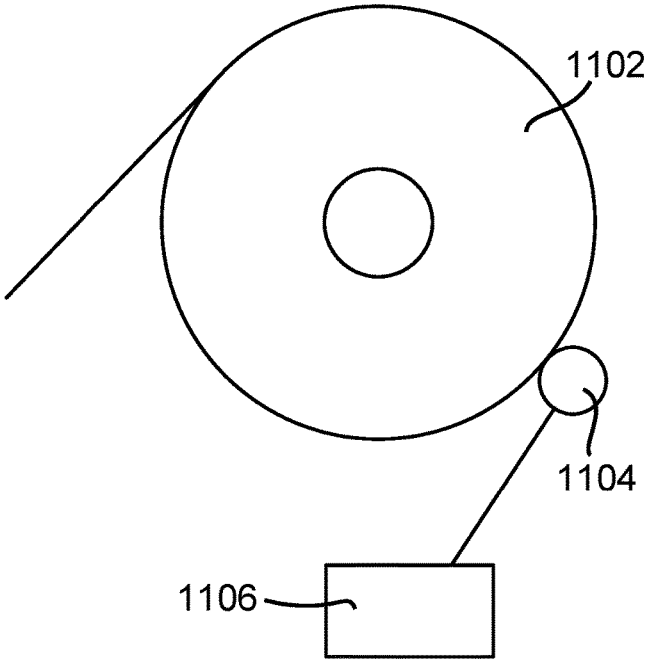
FIG. 11*a* is a diagram of a toilet paper dispenser in accordance with an embodiment of the invention.
Figure 11B:
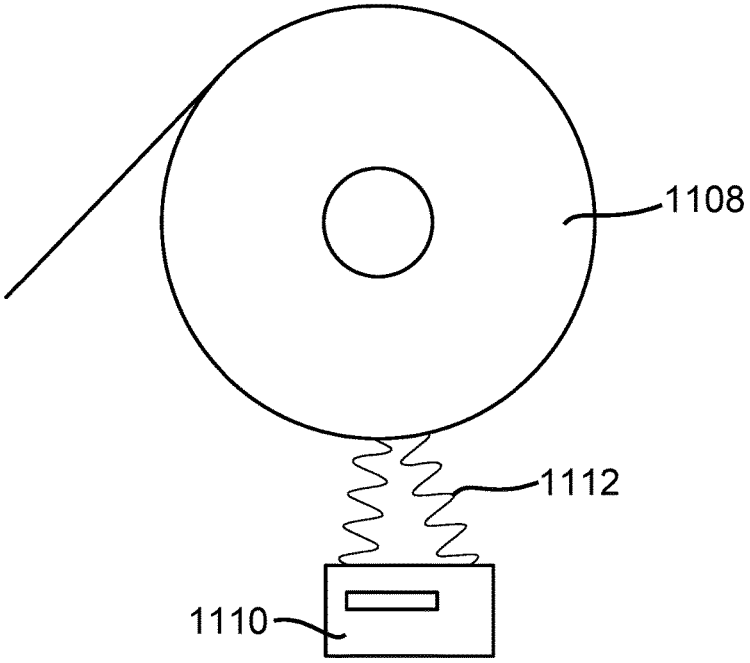
FIG. 11*b* is a diagram of a toilet paper dispenser in accordance with an embodiment of the invention.

FIGS. 11*a* and 11*b* are cross-sectional drawings of toilet paper dispenser tracking systems. These systems may utilize an optical tracking system, mechanical tracking system or an acoustic tracking system. In FIG. 11*a*, as the toilet paper 1102 is dispensed, it rolls along the input devise 1104 which may collect information. This information could include items such as the amount of toilet paper being dispensed, the thickness or weight of the toilet paper, or the amount of toilet paper left on the roll. It may then send that information to the controller box 1106. This box may also house a battery section, which could be charged by the revolutions of the toilet paper roll, and a communication section which may send data wirelessly to the toilets smart flush controller apparatus. In FIG. 11*b*, as the toilet paper 1108 is dispensed, it rolls along the input devise 1112 which may collect information. The information may include data such as the amount of toilet paper being dispensed, the thickness or weight of the toilet paper, and/or the amount of toilet paper left on the roll. It may then send that information to the controller box 1110. This box may also house a battery section, which could be charged by the revolutions of the toilet paper roll, and a communication section which may send data wirelessly to a toilets flush controller or remote computer system.

The toilet and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A smart flush toilet system comprising:

a toilet;

a toilet flush controller which controls a flush length or a flush water volume of a toilet flush event of the toilet;

a toilet paper dispenser which tracks an amount of toilet paper dispensed and reports the amount dispensed to the toilet flush controller;

wherein the toilet paper dispenser communicates wirelessly with the toilet flush controller;

wherein the toilet flush controller controls the flush length or the flush water volume based on the amount of toilet paper dispensed; and a spring located within a body of the toilet paper dispenser, wherein the spring is used as an antenna for communicating wirelessly with the toilet flush controller.

* * * * *